US005765852A

United States Patent [19]

Marega et al.

[11] Patent Number: 5,765,852

[45] Date of Patent: Jun. 16, 1998

[54] DIRECTIONAL OR ADJUSTING PLATE FOR SKI-BOOTS

[75] Inventors: Antonello Marega; Edoardo Strickner, both of Volpago, Italy

[73] Assignee: Tecnica SpA, Treviso, Italy

[21] Appl. No.: 543,553

[22] Filed: Oct. 16, 1995

[30] Foreign Application Priority Data

Oct. 19, 1994 [IT] Italy ..... TV94A0118

[51] Int. Cl.[6] ..... A63C 9/00

[52] U.S. Cl. ..... 280/607; 280/618

[58] Field of Search ..... 280/607, 617, 280/618, 633, 636

[56] References Cited

U.S. PATENT DOCUMENTS 3,917,298 11/1975 Haff .
4,141,570 2/1979 Sudmeier .
4,294,460 10/1981 Kirsch ..... 280/607
4,896,895 1/1990 Bettosini ..... 280/618

FOREIGN PATENT DOCUMENTS 0 337 905 10/1989 European Pat. Off. .
1307982 2/1963 France .
39 15 678 11/1990 Germany .

*Primary Examiner*—Richard M. Camby
*Attorney, Agent, or Firm*—Griffin, Butler, Whisenhunt & Kurtossy

[57] ABSTRACT

A directional or adjusting plate is arranged between the upper surface of the ski and the safety binding for fixing the boot, the position of which can be adjusted so that its longitudinal axis is coincident or translated parallel and/or rotated through a predetermined angle adjustable with respect to the longitudinal axis of the ski.

8 Claims, 5 Drawing Sheets

DIRECTIONAL OR ADJUSTING PLATE FOR SKI-BOOTS

The present invention relates to a directional plate for skiing equipment and more specifically to a directional plate intended to be arranged between the upper surface of the ski and the safety binding for fixing the boot to the ski.

BACKGROUND OF THE INVENTION

It is well-known that the skier, in order to perform the various movements associated with the activity of skiing, transmits very precise commands to the ski via the connecting chain consisting of the bottom part of the leg, the foot, the boot and the binding for anchoring the boot to the ski.

These commands consist in changes in direction of the axis of the ski which are accompanied, especially when performing turns, by rotations of the ski about its vertical and longitudinal axes respectively, so as to point the ski in the new direction and engage the internal or external edge of the ski with the snow- or ice-covered surface.

These commands are accompanied by complementary movements or actions, such as for example displacement of the skier's weight, together with more or less pronounced flexing of the legs and, where necessary, twisting of the pelvis.

Execution of these commands is accompanied by particular positions especially of the skier's foot, positions which obviously are at least partly forced and do not correspond to the normal resting position of the foot.

Naturally, when the sporting activity is prolonged, these forced positions result in muscular fatigue or at least give rise to painful sensations.

These consequences are aggravated when the skier's foot is affected by one of the well-known defects which are referred to as the varus, valgus or flat-footed condition.

In the first two cases, in fact, the foot rests naturally only on the external or internal edge, while in the third case the foot-arch, which also determines the elasticity with which the foot is supported, is greatly reduced or even non-existent.

At the same time the skier's knee is displaced with respect to the axis of the ski, thus preventing proper execution of the commands.

In practical terms the outcome of this situation is often that, when the skier is in the erect position, the toe-ends of his/her feet converge or diverge in the forwards direction, so that the position where the skis are parallel or very close together results in a forced position of the skier's feet inside the boots.

These defects, moreover, result in slower and less precise and efficient transmission of the commands for performing the various manoeuvres and movements.

With regard to the aforementioned aggravating circumstance, this may be such as to generate situations of near intolerable pain so that, when these defects exist, it becomes practically impossible to perform the activity of skiing, unless special footwear is used.

However, this latter expedient is practically impossible to realize in the case of ski-boots which, per se, have a structure which it is difficult to modify.

SUMMARY OF THE INVENTION

The main object of the present invention is to eliminate or reduce substantially the problems and drawbacks briefly mentioned above.

More specifically:

(a) a first object of the present invention is that of providing a solution designed to compensate for defects of the feet which result in convergence or splaying of the toe-ends of the feet, by bringing the knee back onto the axis of the ski;

(b) a second object of the present invention is that of providing means designed to allow more or less rapid rotations of the ski about its longitudinal axis, with the obvious consequences as regards greater or lesser speed of engagement of the edges with the snow- or ice-covered surface, this speed in turn having a decisive effect on the execution of turns and movements.

These and other objects are achieved with the present invention which consists in a directional or adjusting plate, with a width equal to or less than the width of the ski in the part where the bindings for anchoring the boot are mounted, characterized in that it comprises first and second means for effecting fixing respectively to the upper surface of the ski and to the bottom surface of the safety binding for anchoring the boot, said first fixing means being formed so as to allow a rotation, in the horizontal plane, of the axis of the plate with respect to the longitudinal axis of the ski through an angle which can be adjusted and predetermined and/or a translation, still in a horizontal plane, of the plate with respect to the underlying surface of the ski, keeping the axis of the plate parallel to that of the ski, said rotation and translation being able to be combined together.

As can be understood from the description which follows, provided in relation to the accompanying drawings, in the case of rotation of the adjusting or directional plate with respect to the underlying ski, so that the axis of the plate forms an angle with the longitudinal axis of the ski, the angle is chosen so as to allow the foot to position itself with the toes directed inwards, i.e. converging, or outwards, i.e. diverging, while the skis remain substantially parallel and the feet compensate each other, naturally assuming these positions (so that the excessively forced positions which generate fatigue or muscular pain are eliminated) at the same time bringing back the knee into vertical alignment with the axis of the ski.

In turn, by translating the adjusting or directional plate with respect to the plane of the underlying ski, so that the axis of the plate remains parallel with that of the ski, it is possible to obtain, for the same force exerted when performing a turn, a more rapid response of the ski, naturally at the edge towards which the adjusting plate has been translated, or obtain, for the same response time, the response itself with less effort of the foot.

It is obvious that, in all these cases, practising skiing becomes more comfortable and easier.

Moreover with regard to a competitive activity or in any case skiing on very demanding pistes, the choice or adjustment of the position of the adjusting plate according to the invention enables better results to be achieved in terms of athletic performance.

BRIEF DESCRIPTION OF THE DRAWINGS

In the drawings, which represent an entirely non-limiting example of embodiment of the present invention.

DESCRIPTION OF THE PREFERRED EMBODIMENT

Figure 1:
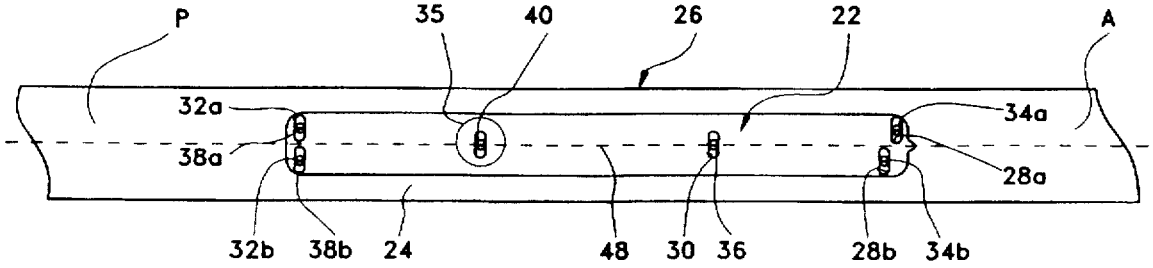
FIG. 1 shows, in diagrammatic form, a plan view of a portion of a ski with, mounted on it, the adjusting or directional plate according to the invention.

With reference first of all to FIG. 1, said Figure shows the directional plate according to the present invention, denoted generally by the reference 22, being mounted on the upper face or surface 24 of a ski 26, shown only partially and for which the letter A indicates the front end while the letter P indicates the rear end. Consequently the tip of the ski 26 is located at the end A and the tail is located at the end P.

The plate 22, as can be seen from the successive illustrations, has a substantially parallelepiped shape (where necessary with rounded edges for aerodynamic and safety reasons) and has three groups of eyelets, denoted respectively by the reference numbers 28 (*a* and *b*), 30 and 32 (*a* and *b*) in which there are slidably seated pins, respectively 34 (*a* and *b*), 36 and 38 (*a* and *b*), integral with the upper face 24 of the ski 26.

It is obvious that the cooperation between pins and eyelets allows rotational displacements and/or translation of the plate 22 with respect to the underlying surface of the ski, provided that the tranverse dimension of the eyelets is slightly greater than the diameter of the pins, with the consequences that can be appreciated with reference to the other illustrations.

It must obviously be pointed out that the representation of the eyelets and pins is provided solely for illustrative and exemplary purposes, it being understood that other mechanically and conceptually equivalent solutions are possible and may be envisaged.

Figure 2:
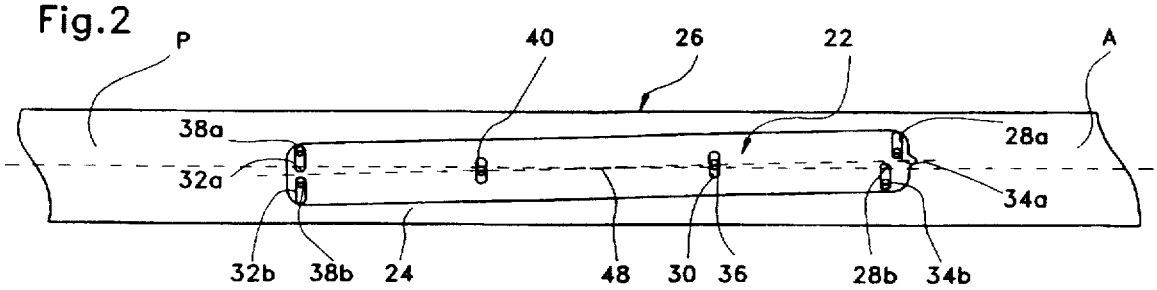
FIGS. 2 and 3 show the same ski portion of FIG. 1 with the directional plate in two different adjusting conditions.

In particular, rotation of the plate 22, shown by way of example in FIG. 2, in practice involves the displacement of the front end of the plate 22 so that the pins 34*a* and 34*b* are located at the right-hand end of the respective eyelets 28*a* and 28*b* (when viewing the ski from the tail P towards the tip A), as is the case for the pin 36 with respect to the eyelet 30.

Figure 3:
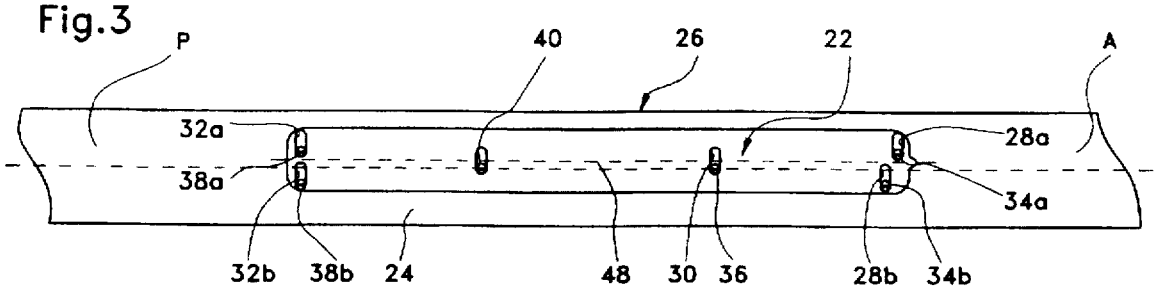

The rotation of the plate 22 occurs in reality about the centre or vertical axis identified in FIGS. 1 to 3 by the reference number 40, so that, as far as the pins 38*a* and 38*b* are concerned, these are located at the left-hand end of the respective eyelets 32*a* and 32*b*. Obviously rotation of the plate 22 with respect to the upper surface of the ski can also occur in the opposite direction, and the amplitude of the angle of rotation depends obviously on the extension of the eyelets 28, 30 and 32, whereby the eyelet with a smaller extension performs a controlling function.

FIG. 3 illustrates the case where the plate 22 is translated with respect to the upper surface 24 of the ski 26; the respective positions of the pins with respect to the eyelets clearly show the relative displacements which occur in this case.

Figure 4:
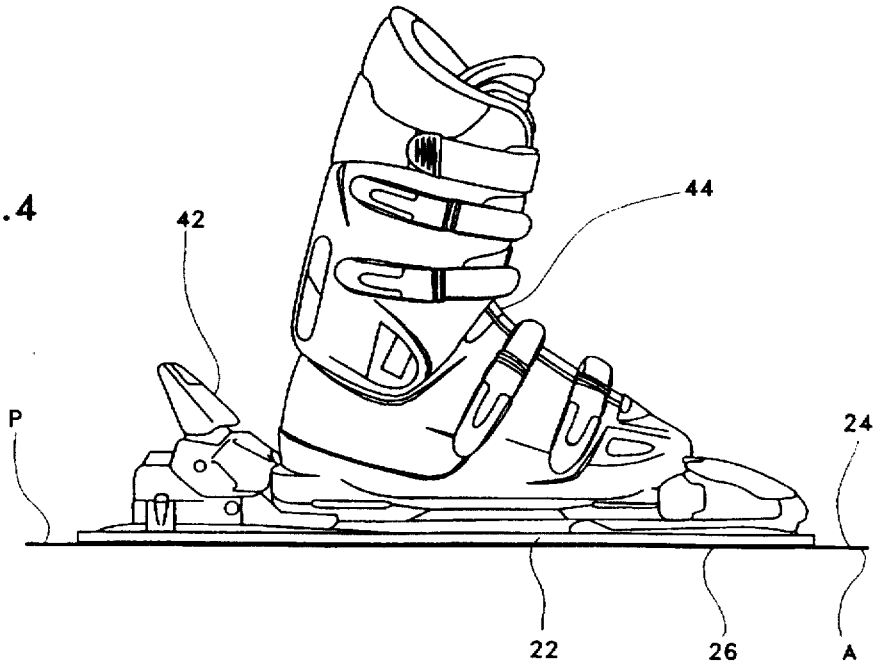
FIG. 4 shows a side view of a ski which has mounted on it the directional plate to which, in turn, the binding for fastening the boot is fixed, the latter being in turn removably mounted on the binding.

If we now take into consideration FIG. 4, the directional plate 22, associated with the upper surface 24 of the ski 26, is shown in its assembled condition in combination with the safety binding 42 and the boot 44.

Obviously the safety binding (which, as will be remembered, allows rapid fastening and release of the boot to/from the ski) is rigidly fixed to the directional plate 22, so that the longitudinal axis of the boot coincides perfectly with that of the plate 22 and consequently the relative position of the longitudinal axes of the ski and the plate, respectively, coincides with that of the boot 44 with respect to the said ski.

Obviously mounting of the safety binding 42 on the plate 22 will be performed in a conventional manner (for example by means of screws), whilst ensuring that this does not affect also the body of the ski, in order to avoid undesirable interference between safety binding and hence boot on the one hand and ski on the other hand.

FIGS. 5 to 8 show the normal condition in which the longitudinal axis 46 of the ski coincides with the longitudinal axis 48 of the plate 22.

Figures 5, 6, 7, 8:
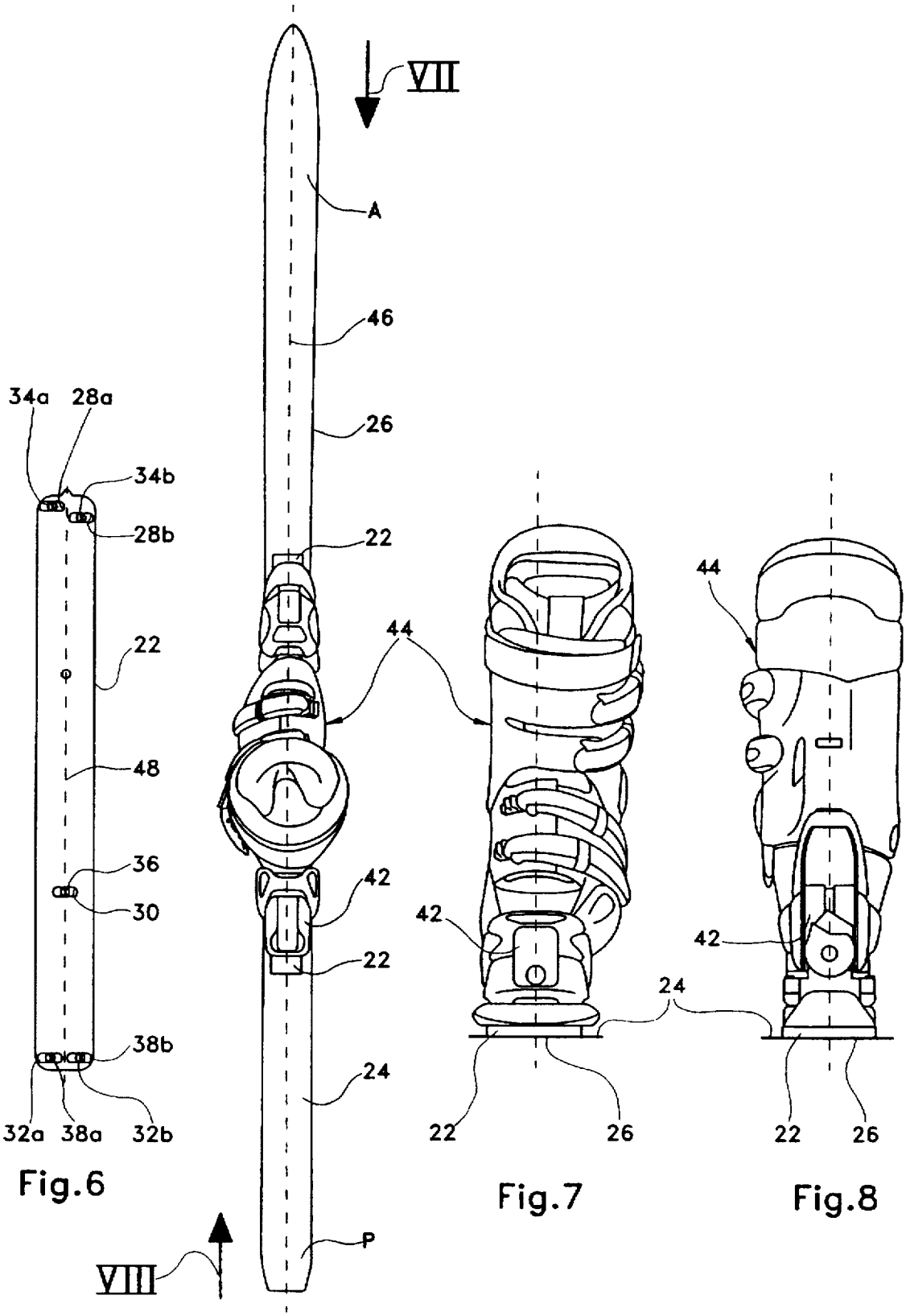
FIGS. 5, 7 and 8 are overall views of FIG. 4, i.e. a top plan view (FIG. 5), a front end view in the direction of the arrow VII of FIG. 5 (FIG. 7) and a rear end view in the direction of the arrow VIII of FIG. 5 (FIG. 8)
FIG. 6 is a plan view of the directional plate alone in the condition of FIG. 5.

In particular from FIGS. 7 and 8 it can be seen that the plate 22 is located between the upper face of the ski and the safety binding: in this respect it must be pointed out that the thickness of the plate 22 must be as small as possible so as to avoid the boot being raised excessively with respect to the plane of the ski 26.

Obviously, in FIG. 6, for the sake of clarity of the description, the pins cooperating with the eyelets are also shown, even though these pins in reality are integral with the upper surface of the underlying ski.

On the other hand, the means 35 used for mutually locking the pins with respect to the eyelets, once the desired relative position thereof has been determined, said means consisting, for example, of bolts which can be rotated with the pins between two positions for engagement and disengagement, respectively, with corresponding cavities formed in the adjacent flanks of the eyelets.

Figure 10:
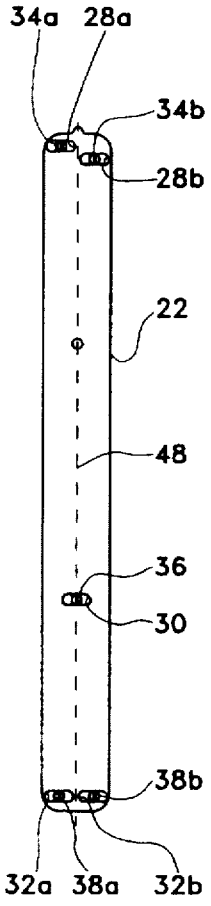
FIGS. 9, 10, 11 and 12 are views similar to FIGS. 5, 6, 7 and 8 of the assembly of FIG. 4 with the directional plate totally translated to the right with respect to the longitudinal axis of the ski.

With reference now to FIGS. 9 to 12, these show the situation where the directional plate 22 is translated towards the right with respect to the ski 26, with the configuration of the pins and eyelets shown in FIG. 10.

Figure 9:
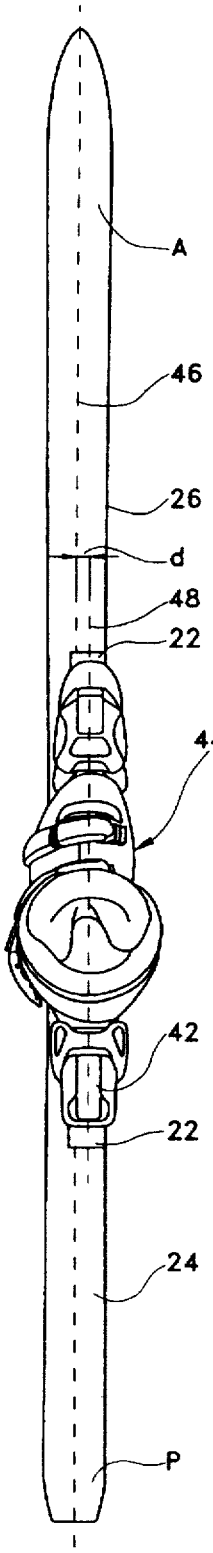

From FIG. 9 it is possible to see that the two longitudinal axes, 46 for the ski, and 48 for the plate 22 and hence the boot 44, are now separated by a distance "d" which is the maximum distance permitted by the eyelet 30, while remaining perfectly parallel, however.

Figure 11:
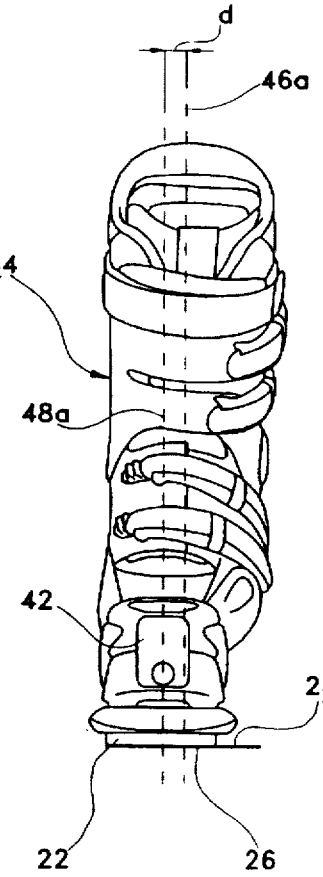
Figure 12:
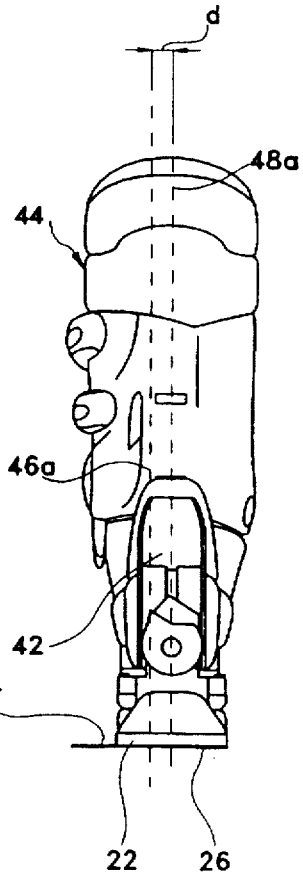

FIGS. 11 and 12 also show how the said displacement by the amount "d" occurs between the vertical axes 46*a* and 48*a* which are respectively perpendicular to the longitudinal axes 46 and 48 of the ski and the directional plate.

If the ski 26 shown in FIG. 9 is the left-hand ski of the skier it is obvious that rotation of the ski about its longitudinal axis, as a result of the command for inclination of the boot towards the inside of the ski, causes the edge of the ski to interact with the underlying snow- or ice-covered layer with a smaller rotation than that which is normally necessary in order to obtain the same angle of incidence.

Alternatively, for the same command causing inclination and hence rotation of the ski with respect to its longitudinal axis, the incidence of the edge of the ski with respect to the snow-covered surface is much greater and hence the manoeuvre or movement (such as for example the execution of a curving or turning movement) occurs in a much shorter time.

In other words, execution of a turn occurs in a time interval and within a travel distance which are distinctly shorter compared to the same manoeuvre performed with the directional plate and hence the boot in the condition shown in FIG. 5.

Figure 13:
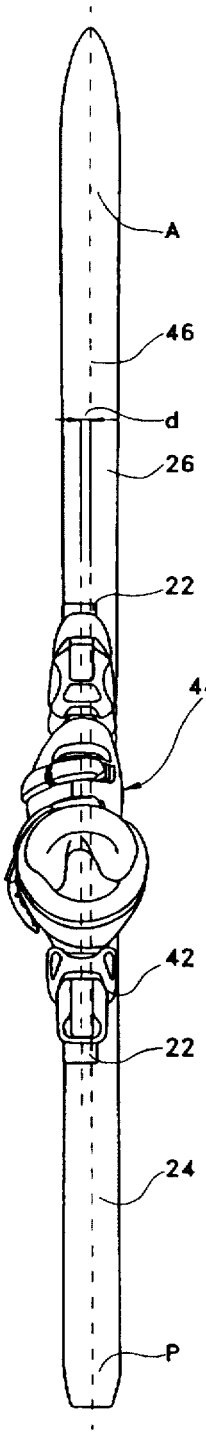
FIGS. 13 and 14 are views similar to those of FIGS. 9 and 11, but with the directional plate totally translated to the left with respect to the longitudinal axis of the ski.
Figure 14:
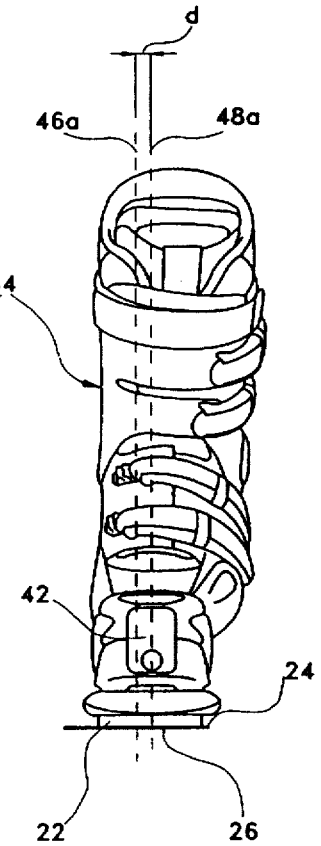

FIGS. 13 and 14 show the same situation illustrated in FIGS. 9 and 11, except that the directional plate 22 is in this case translated towards the left by the same distance "d" and hence the same observations already made for the preceding figures are applicable here.

It merely remains to be said that, when using directional plates according to the present invention, the right-hand ski and left-hand ski of a pair of skis must be identified.

If we now consider FIGS. 15 to 18, these show the case where the directional plate 22 is rotated with respect to the longitudinal axis of the ski, so that an angle alpha of predetermined value is formed between the longitudinal axis 46 of the ski and the longitudinal axis 48 of the plate.

Figure 19:
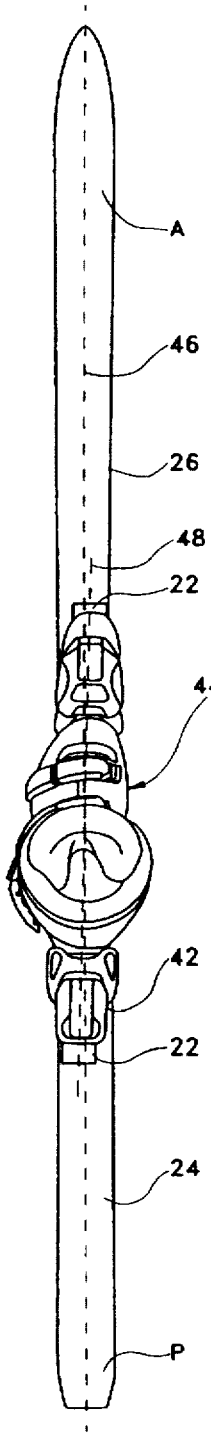
FIGS. 19 and 20 are views similar to those of FIGS. 15 and 17 with the directional plate rotated this time to the right through a predetermined angle.
Figure 20:
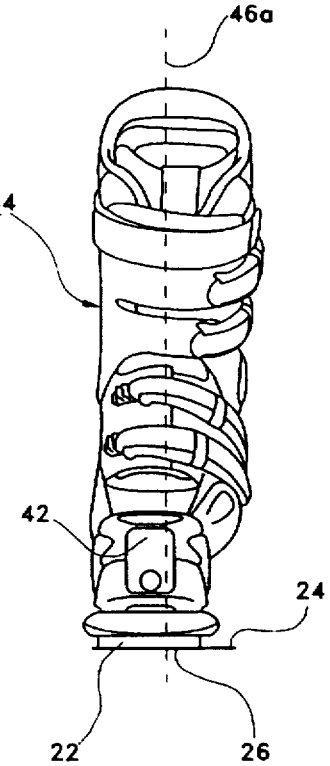
Figure 16:
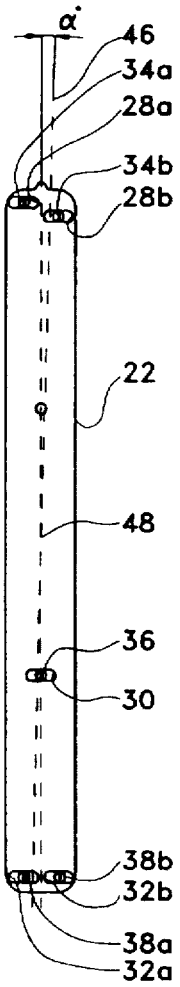
FIGS. 15, 16, 17 and 18 are views similar to those of FIGS. 5, 6, 7 and 8 of the assembly of FIG. 4 with the directional plate rotated through a predetermined angle to the left with respect to the longitudinal axis of the ski.
Figure 15:
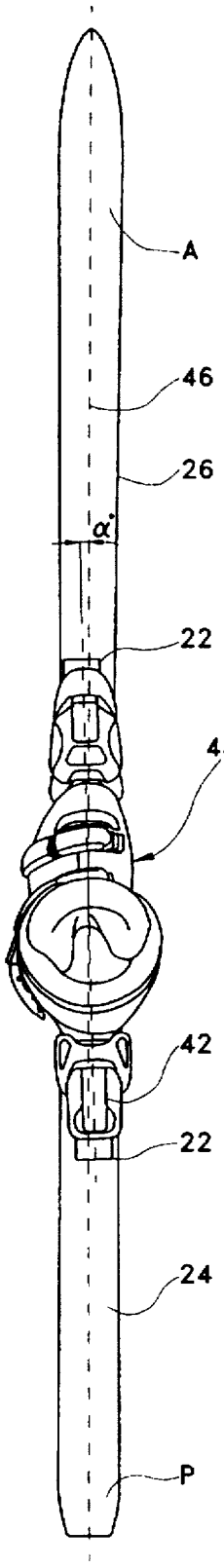
Figure 17:
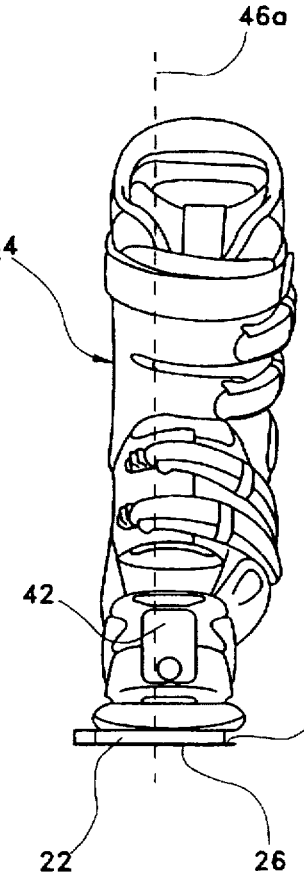
Figure 18:
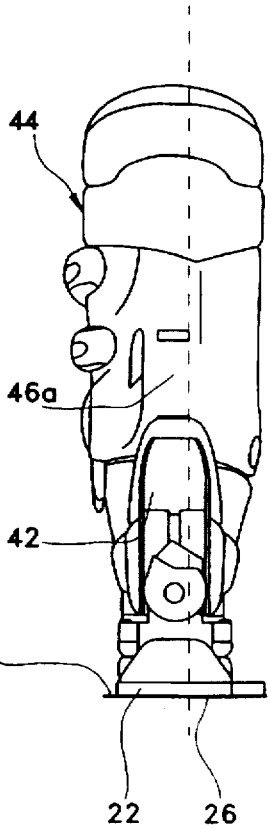

In FIG. 15 it can be clearly seen that the ski in this case is the right-hand ski, so that the boot 44 is arranged with its front end directed inwards, while the longitudinal axis of the ski remains in the normal condition. This means that, by combining the right-hand ski of FIG. 15 with the left-hand ski of FIG. 19, a situation is obtained in which the longitudinal axes of the two skis are parallel, while the two boots have their front ends directed inwards through an angle which is predetermined and variable as required (obviously within the limits of a few degrees which are sufficient to allow compensation of normal defects of the feet).

The directional plates according to the present invention have been subjected to specific tests performed in the field, i.e. during specialist skiing activities such as the slalom and giant slalom.

The tests were performed on glaciers during two separate periods of the year so that the snow conditions were substantially different.

Numerous tests were carried out with different positions of the directional plates, and each volunteer, chosen from internationally experienced and renowned athletes, performed two downhill runs for each test, these runs being timed and compared with two identical downhill runs performed with the same plates in the neutral position (i.e. parallel to the longitudinal axis of the ski and centered with respect to the same axis).

More specifically, the result of each test (i.e. comprising four downhill runs, the first and last of which were performed with the directional plates in the neutral position and the two middle ones with the plate at an angle) was calculated as a relative time.

It should be pointed out that the circuit for the ordinary slalom contained 12 gates, with a normal descent time of about 9 seconds, while the circuit for the giant slalom contained 10 gates and the descent time was about 17 seconds.

Table 1 shows the results of the tests carried out by an athlete who performed the test runs for the giant slalom on two different glaciers and hence, as mentioned, in different snow conditions and on slopes of varying steepness.

These conditions, as well as the angled or axially displaced positions of the directional plates, are indicated together with the aforementioned relative times in Table 1 below.

Table 2, on the other hand, shows the data and the results of the slalom tests carried out on one of the two glaciers:

TABLE 1

| | GIANT SLALOM | | | | | |
|---|---|---|---|---|---|---|
| | Parallel outwards | Front outwards | Rear outwards | Parallel inwards | Front inwards | Rear inwards |
| Hochfügen: Medium curvature Steepness: 24°, 14° Soft snow | −0.01 | −0.05 | 0.03 | 0.20 | 0.18 | −0.09 |
| Kaunertal: Longer curvature Steepness: 13°, 20° Hard snow | −0.09 | −0.07<br>0.00* | 0.004 | — | — | −0.18<br>−0.09* |

TABLE 2

| | SLALOM | | | | | |
|---|---|---|---|---|---|---|
| | Parallel outwards | Front outwards | Rear outwards | Parallel inwards | Front inwards | Rear inwards |
| Kaunertal: Medium Curvature Steepness: 20° Hard snow | — | 0.04 | 0.06 | −0.04<br>−0.09 | −0.06 | 0.13 |

1) "Parallel" means displacement of the plate parallel to the longitudinal axis of the ski.
2) "Front" and "Rear" mean that the front part or rear part, respectively, of the plate is inclined towards the side of the ski indicated.

From the above results it is clear how the use of the directional plates according to the present invention gives rise to advantages which are certainly not insignificant such as a reduction in the descent times.

Secondly it is worth noting that, depending on the type of run, different arrangements of the directional plates produce favourable results.

In particular, Table 1 clearly shows that, in the case of the giant slalom, compared to the neutral position, undoubtedly surprising results are obtained if the directional plates are angled with the front part towards the inner side of the corresponding ski.

Equally advantageous results are obtained from those arrangements where the directional plates are angled with the front end directed towards the outer side of the corresponding ski or also from the arrangement where the directional plates are not angled but are axially displaced towards the outer side of the ski.

From Table 1, finally it is possible to understand the importance of the steepness of the run and the snow conditions for the performance of the directional plates, but in any case a qualitative improvement is obtained.

From Table 2, on the other hand, which relates to the ordinary slalom tests, it can be noted that the best times are obtained with the directional plates angled such that the front part is directed towards the inner side of the ski and with the directional plates not angled, but axially displaced, parallel to the longitudinal axis of the ski, towards the inner side of the ski.

Obviously the abovementioned differences are intrinsically associated with the substantially different characteristics of the runs: for example, in the case of the ordinary slalom, the greater number of gates forces the athlete to perform tighter and faster turns, while in the case of the giant slalom the smaller number of gates and the greater distance of the run result in a substantially different behaviour of the athlete.

Obviously, in particular cases, it is also possible to rotate the directional plate in the opposite direction with respect to the longitudinal axis of the ski, if it is required for example to compensate different defects or allow special movements.

The invention has been described in relation to preferred embodiments, it being understood that conceptually or mechanically equivalent modifications and variants are possible and may be envisaged, without departing from the scope thereof.

For example the means for anchoring the directional plate to the ski and for rotation and/or translation of the plate with respect to the ski may be realized with different configurations from the pin-and-eyelet configuration illustrated.

Furthermore, it is also possible to envisage combining rotation of the plate with translation thereof, again depending on the desired technical effect and/or the correction required.

We claim:

1. A directional plate for adjustably displacing and fixing a longitudinal axis of a ski boot binding relative to a longitudinal axis of a ski, comprising:

a plate disposed between and in contact with a bottom surface of the boot binding and an upper surface of the ski and being lockably displaceable in a plane parallel to the upper surface of the ski;

a first fixing means for releasably fixing the plate to the upper surface of the ski;

a second fixing means for fixing the plate to the boot binding;

and wherein said first fixing means has two pairs of elongated eyelets formed in the plate and each elongated eyelet is positioned near ends of the plate in substantially symmetrical positions with respect to a longitudinal axis of the plate and a third elongated eyelet formed in the plate and positioned substantially symmetrically straddling the longitudinal axis of the plate, pins integral with the upper surface of the ski and positioned to pass through said elongated eyelets, and releasable lock means for releasably locking the pins with respect to the elongated eyelets.

2. Directional plate according to claim 1, wherein the plate has a width equal to or less than a width of the ski in the part where the boot bindings are mounted.

3. Directional plate according to claim 1, wherein the relative displacement of the plate consists in a rotation of the plate with respect to the upper surface of the ski so that an adjustable and lockable angle of the desired magnitude is formed between the longitudinal axis of the plate and the longitudinal axis of the ski.

4. Directional plate according to claim 3, wherein said rotation is performed about an axis perpendicular to said plane and passing through the longitudinal axis both of the plate and of the ski, the intersection between said perpendicular axis and plane being positioned at a point situated between said third eyelet and said pair of eyelets positioned near the rear end of said plate.

5. Directional plate according to claim 3, wherein a maximum amplitude of said rotation is controlled by an extension of said eyelets.

6. Directional plate according to claim 1, wherein said displacement consists in a controlled and adjustable translation of the plate with respect to the upper surface of the ski so that the longitudinal axis of said plate remains parallel to the longitudinal axis of said ski, and a maximum translation of said plate being controlled by an extension of said eyelets.

7. Directional plate according to claim 1, wherein said displacement consists in a combination of a rotation of the plate with respect to the upper surface of the ski so that an adjustable angle of desired magnitude is formed between the longitudinal axis of the plate and the longitudinal axis of the ski, and of a controlled and adjustable translation of the plate with respect to the upper surface of the ski.

8. Directional plate according to claim 1, wherein said eyelets have a transverse dimension slightly greater than a diameter of said pins, so as to allow rotation of said plate with respect to said ski.

* * * * *